United States Patent [19]

LaBate

[11] Patent Number: 4,630,667

[45] Date of Patent: Dec. 23, 1986

[54] COATED REFRACTORY SHAPES USEFUL IN BOTTOM POURING OF INGOTS IN INGOT MOLDS

[76] Inventor: Michael D. LaBate, 115 Hazen Ave., Ellwood City, Pa. 16117

[21] Appl. No.: 755,734

[22] Filed: Jul. 17, 1985

[51] Int. Cl.[4] ..... B22C 9/08

[52] U.S. Cl. ..... 164/363; 164/138; 249/109

[58] Field of Search ..... 164/138, 363, 364; 249/108, 109, 110

[56] References Cited

U.S. PATENT DOCUMENTS

| | | | |
|---|---|---|---|
| 3,401,735 | 9/1968 | Pursall | 164/138 |
| 3,809,148 | 5/1974 | Pulsifer | 164/138 |
| 3,934,637 | 1/1976 | Potier | 164/138 |
| 4,356,994 | 11/1982 | Thornton | 164/363 |

FOREIGN PATENT DOCUMENTS

| | | | |
|---|---|---|---|
| 2132379 | 11/1972 | France | 164/138 |
| 0833356 | 5/1981 | U.S.S.R. | 164/138 |
| 0865482 | 9/1981 | U.S.S.R. | 164/138 |
| 0863142 | 9/1981 | U.S.S.R. | 164/138 |

*Primary Examiner*—Nicholas P. Godici
*Assistant Examiner*—Richard K. Seidel
*Attorney, Agent, or Firm*—Harpman & Harpman

[57] ABSTRACT

Refractory shapes such as tubular tiles and tubular runners are provided with a novel graphite interior coating penetrating the refractory and forming with the refractory a lining that resists erosion of molten metal flowing therethrough. The coated refractory shapes are particularly useful in forming mold assemblies for bottom pouring.

5 Claims, 3 Drawing Figures

COATED REFRACTORY SHAPES USEFUL IN BOTTOM POURING OF INGOTS IN INGOT MOLDS

BACKGROUND OF THE INVENTION

1. Technical Field

This invention relates to coated refractory shapes such as those used in bottom pouring of ingots in ingot molds.

2. Description of the Prior Art

Prior devices and assemblies used in bottom pouring of ingots and cast shapes from molten metal have included various structures such as those seen in U.S. Pat. Nos. 3,604,598, 3,810,506, 3,929,184, 3,865,177, 4,111,254, 4,356,994, 4,452,296 and 4,506,813.

Typical arrangements of multiple mold bottom pouring are illustrated in the above U.S. Pat. Nos. 3,810,506 and 3,865,117 wherein a vertically standing fountain or trumpet is positioned adjacent one or more ingot molds or the like.

U.S. Pat. No. 3,604,598 adds electrical heating to a bottom pour-teeming vessel. U.S. Pat. No. 3,929,184 discloses the metal receiving and transferring fountain or trumpet formed of a plurality of refractory sections. U.S. Pat. No. 4,111,254 discloses the formation of a casting mold made of sheet metal embedded in a supporting mass of refractory particles. U.S. Pat. No. 4,356,994 discloses the units of a pouring system for a so-called uphill teeming as comprising an outer casing having an inner refractory liner and a refractory insulating material therebetween. U.S. Pat. No. 4,452,296 discloses an aluminum-diffusion coated steel pipe gating system which represents the fountain or trumpet of a bottom pour assembly including a mold. U.S. Pat. No. 4,506,813 discloses a fountain or a trumpet of a bottom pour arrangement formed of a refractory tube in a sheath with a body of particulate material between the refractory tube and the sheath.

The present invention eliminates the problems found in the prior art devices by forming the tiles or inserts which are sometimes termed a refractory lining in a fountain or a trumpet as refractory shapes having an inner coating of a graphite composition capable of penetrating the refractory surface to form a coating that resists flaking or parting of the refractory when subjected to molten metal by controlling the degree of heat transfer for a period of time sufficient to permit the refractory to adjust to the elevated temperature at a rate of expansion less than that resulting in flaking or parting of the refractory.

SUMMARY OF THE INVENTION

Coated refractory shapes useful in bottom pouring of ingots in ingot molds are disclosed, the refractory shapes being coated on their hot metal engaging surfaces with a graphite containing composition that penetrates the refractory and with it forms a lining that controls the rate of heat exchange between the lining and the balance of the refractory shape which eliminates normal thermal shocking and the resulting flaking or parting of the refractory as well as substantially reducing the erosion rate of the penetrated refractory to render the same totally predictable by precalculating the desired depth of the graphite coating.

DESCRIPTION OF THE PREFERRED EMBODIMENT

Figure 1:
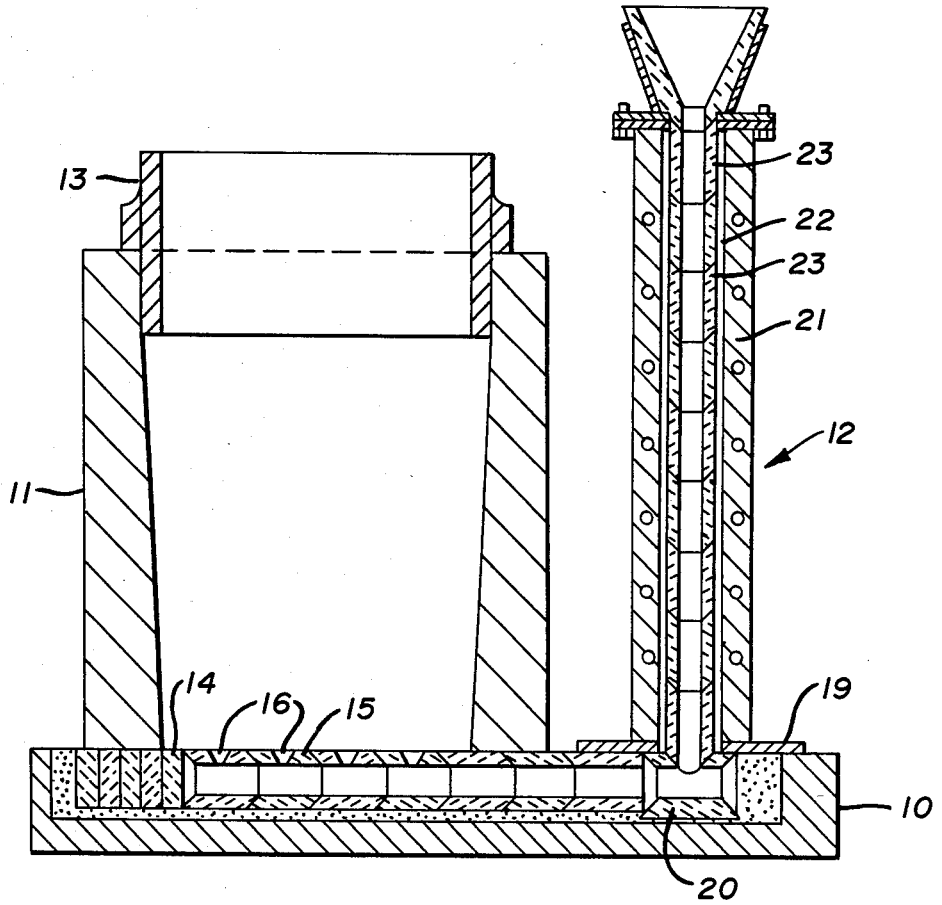
FIG. 1 is a schematic arrangement in vertical section of a mold assembly for bottom pouring incorporating the coated refractory shapes.
Figure 3:
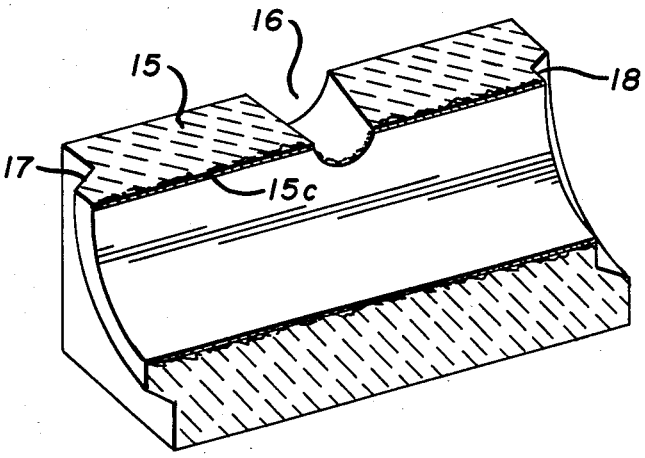
FIG. 3 is a perspective view of a quarter section of a runner used in the mold assembly shown in FIG. 1.
Figure 2:
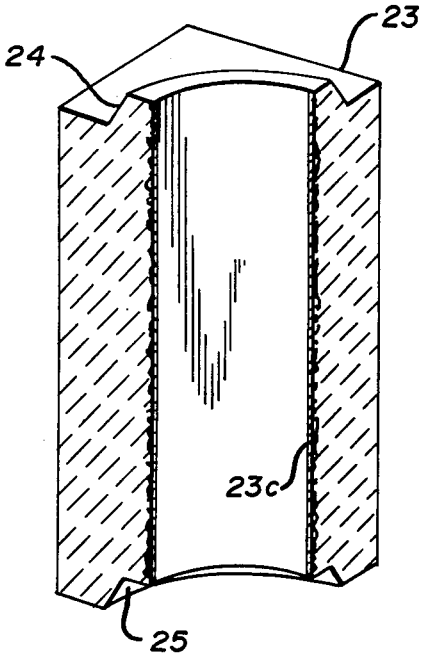
FIG. 2 is a perspective view of a quarter section of a tile used in the mold assembly shown in FIG. 1.

By referring to the drawings and FIG. 1 in particular it will be seen that a vertical section of a schematic arrangement of parts of a mold assembly for bottom pouring is illustrated wherein a mold stool 10 supports an ingot mold 11 and a trumpet 12. The ingot mold 11 is illustrated with a hot top 13 thereon and with its open bottom resting upon refractory units 14 including runners 15 having outlets 16 in their upper surface. The runners 16 are hollow and positioned in end to end relation with interlocking end configurations 17 and 18 respectively as best seen in FIG. 3 of the drawings. The trumpet 12 rests on a plate 19 positioned on the mold stool 10 over the runners 15 and/or an open topped shape incorporating a bottom section including a king brick 20. The trumpet 12 is formed of a tubular metal shape 21 which may be water cooled if desired and forms a vertical passageway 22 in which a plurality of coated refractory shapes in the form of tiles 23 are arranged in superimposed relation. The ends of the tiles 23 have interlocking configurations 24 and 25 respectively, formed thereon as best seen in FIG. 2 of the drawings. Each of the runners 15 and each of the tiles 23 have an inner coating 15C and 23C respectively, which in the quarter sections of FIGS. 2 and 3 of the drawings are shown penetrating the refractory material of the runners 15 and tiles 23 respectively to a desirable depth so as to form with the refractory material of the runners 15 and tiles 23 a lining which controls heat transfer from molten metal to the remainder of the runners 15 or tiles 23.

The refractory material of which the runners 15 and tiles 23 are formed is preferably clay or a mixture of clay including dolomite, sand, granulated slag and ground fired clay together with a suitable bonding material which may be anyone of the following: resin urea formaldehyde, sodium silicate, and phenolic resin. The graphite coating material is preferably synthetic graphite of colloidal size including micron colloidal and micro micron colloidal particle size or larger. The liquid carrier is preferably an aqueous solution including hydrochloric acid, sodium silicate and water soluable carboxy vinyl polymer resin. A typical liquid coating material would include substantially 10% by weight micron colloidal particles of graphite, 7% by weight concentrated hydrochloric acid of substantially 90% purity, substantially 18% by weight water, substantially 32% by weight aqueous sodium silicate solution wherein the sodium silicate is present at about 40% by weight of the solution and substantially 33% by weight water soluable carboxy vinyl polymer resin as a powder wherein the resin is present at substantially 8% by weight of the solution. An alternate liquid carrier has been found to produce a suitable suspension of the micron particles of graphite by substituting xanthan gum for the carboxy vinyl polymer resin, the gum is a natural high moleculr weight linear polysaccharide functioning as a hydrophilic colloid to maintain the micron particles of graphite in suspension and contribute to the penetrating of the coating as described hereinbefore.

Effective coatings for the refractory tiles and runners may be formed with colloidal graphite in amounts between 5% to 25% by weight, between 34% to 75% by weight of a solution of water and sodium silicate wherein the water is present at about 60% of the solution, between about 2% to 10% concentrated hydrochloric acid of a 90% purity weight, between about 33% to 75% of a solution of water, acid carboxy vinyl polymer resin wherein the resin is present in amounts between 1% to 10% of the solution by weight and between about 15% to 20% water by weight.

Those skilled in the art will observe that the liquid carriers described herein comprise an effective wetting agent which contributes to the ability of the particles of colloidal graphite to penetrate the refractory material of the tiles and runners and form a smooth dry coating on the penetrated surface.

It is believed that the penetrating ability of the liquid carrier and graphite suspension is improved by the addition of from 1 to 10 parts by weight of micron silicon particles.

It will occur to those skilled in the art that the thickness of the coating material forming the lining of the runner 15 and tile 23 as seen in FIGS. 2 and 3 of the drawings has been somewhat exaggerated and it will occur to those skilled in the art that the thickness of the coating formed after the penetration of the graphite material into the refractory may be varied by applying successive coatings of the graphite suspension material as hereinbefore described.

It will further occur to those skilled in the art that by forming sleeve-like liners of the graphite material hereinbefore described and hardening the same, the sleeve-like liners may be installed in the runners and tiles before or after the same have been heat dried and/or fired as necessary in the formation of such refractory articles and that the resulting sleeve-like linings of the graphite material will also resist heat transfer from molten metal to the refractory sufficiently to eliminate the usual thermal shock and the resulting flaking or parting of the refractory.

A further modification of the invention applies the graphite material to all of the surfaces of the tiles 23 or runners 18 or other similar refractory shapes by submerging the tiles, runners, and other refractory shapes in the liquid carrier suspension of the graphite for a time sufficient for the penetration of the several surfaces of the refractory shapes to occur and the formation of a smooth coating on the several surfaces of the refractory shapes.

Such treatment of the refractory shapes can be easily formed by dipping the shapes in the liquid carrier of the graphite suspension and the subsequent drying thereof.

Having thus described my invention, what I claim is:

1. A plurality of refractory tubular tiles and runners forming an assembly for bottom pouring molten metal in an ingot mold wherein said tubular tiles and runners have smooth inner surfaces for guiding said molten metal and a penetrating heat insulating coating on said inner surfaces controlling heat transfer from said molten metal to said refractory tubular tiles and runners.

2. In an ingot mold assembly for the bottom pouring of molten metal into said ingot mold having a plurality of connecting horizontally disposed hollow tiles communicating with said ingot mold and a plurality of connecting vertically disposed hollow tiles communicating with said horizontally disposed hollow tiles; the improvement comprising said hollow tiles being formed of refractory material and a penetrating heat insulating lining in the interior of said hollow tiles for controlling heat transfer from molten metal therein to said refractory material whereby thermal shock and resultant cracking and spalling of said refractory material is controlled.

3. The improvement in the ingot mold assembly of claim 2 and wherein said hollow tiles are formed of a mixture of materials from a group comprising clay, dolomite, sand, granulated slag, and ground fired clay and bonding material from a group comprising resin urea formaldehyde, sodium silicate, and phenolic resin, said hollow tiles being capable of penetration by said heat insulating lining.

4. The improvement in the ingot mold assembly of claim 2 and wherein said heat insulating lining is formed from a liquid suspension of colloidal graphite particles, said liquid consisting of an aqueous solution of hydrochloric acid, sodium silicate, and water soluble carboxy vinyl polymer resin so as to form a smooth dry lining penetrating the refractory material of said hollow tiles.

5. The improvement in the ingot mold assembly of claim 2 and wherein said heat insulating lining is formed of a liquid suspension of colloidal graphite particles, the liquid consisting of an aqueous solution of hydrochloric acid, sodium silicate, and water soluble xanthan gum so as to form a smooth dry lining penetrating the refractory material of said hollow tiles.

* * * * *